US007915472B2

(12) United States Patent
Wright et al.

(10) Patent No.: US 7,915,472 B2
(45) Date of Patent: Mar. 29, 2011

(54) SURFACE DECONTAMINATION COMPOSITIONS AND METHODS

(75) Inventors: Karen E. Wright, Idaho Falls, ID (US); David C. Cooper, Idaho Falls, ID (US); Dean R. Peterman, Idaho Falls, ID (US); Ricky L. Demmer, Idaho Falls, ID (US); Julia L. Tripp, Pocatello, ID (US); Laurence C. Hull, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 442 days.

(21) Appl. No.: 11/350,351

(22) Filed: Feb. 7, 2006

(65) Prior Publication Data

US 2007/0185365 A1 Aug. 9, 2007

(51) Int. Cl.
*G21F 9/00* (2006.01)

(52) U.S. Cl. ..... 588/9; 588/1; 588/901

(58) Field of Classification Search ..... None
See application file for complete search history.

(56) References Cited

U.S. PATENT DOCUMENTS

| | | | | |
|---|---|---|---|---|
| 3,047,434 | A | 7/1962 | Bulat | |
| 4,659,512 | A | 4/1987 | Macedo et al. | |
| 4,850,729 | A * | 7/1989 | Kramer et al. | 401/183 |
| 4,865,761 | A | 9/1989 | Mandel et al. | |
| 4,913,835 | A | 4/1990 | Mandel et al. | |
| RE34,041 | E * | 8/1992 | Doan | 86/33 |
| 5,242,503 | A | 9/1993 | Grant et al. | |
| 5,254,290 | A | 10/1993 | Blandiaux et al. | |
| 5,368,158 | A | 11/1994 | Miaud | |
| 5,421,897 | A * | 6/1995 | Grawe | 134/6 |
| 5,434,331 | A | 7/1995 | Barkatt et al. | |
| 5,635,075 | A * | 6/1997 | Boyd et al. | 210/747 |
| 5,678,233 | A | 10/1997 | Brown | |
| 5,926,771 | A | 7/1999 | Brown | |
| 5,972,310 | A | 10/1999 | Sachetto | |
| 6,106,774 | A * | 8/2000 | Monticello et al. | 422/28 |
| 6,288,076 | B1 * | 9/2001 | Kostyniak et al. | 514/299 |
| 6,333,054 | B1 * | 12/2001 | Rogozinski | 424/661 |
| 6,569,353 | B1 | 5/2003 | Giletto et al. | |
| 6,723,890 | B2 | 4/2004 | Tucker et al. | |
| 6,818,300 | B2 | 11/2004 | Loyd et al. | |
| 7,662,754 | B2 | 2/2010 | Faure et al. | |
| 2003/0060517 | A1 | 3/2003 | Tucker et al. | |
| 2005/0069566 | A1 | 3/2005 | Tamarkin et al. | |
| 2005/0163994 | A1 | 7/2005 | Rouppert et al. | |
| 2005/0239674 | A1 * | 10/2005 | Dreja et al. | 510/180 |
| 2006/0128585 | A1 * | 6/2006 | Adair et al. | 510/383 |
| 2006/0140984 | A1 | 6/2006 | Tamarkin et al. | |
| 2006/0211592 | A1 | 9/2006 | Faure et al. | |

(Continued)

OTHER PUBLICATIONS

International Preliminary Report on Patentability/Written Opinion of the International Searching Authority, PCT/US2007/061295, International Filing Date Jan. 30, 2007.

(Continued)

*Primary Examiner* — Melvin C Mayes
*Assistant Examiner* — Sheng H Davis
(74) *Attorney, Agent, or Firm* — TraskBritt

(57) ABSTRACT

Clay-based compositions capable of absorbing contaminants from surfaces or objects having surface faces may be applied to a surface and later removed, the removed clay-based compositions absorbing at least a portion of the contaminant from the surface or object to which it was applied.

6 Claims, 3 Drawing Sheets

U.S. PATENT DOCUMENTS

2009/0264330 A1 10/2009 Bruckner et al.

OTHER PUBLICATIONS

Steadman's Medical Dictionary Illustrated, 23 ed., 1976, p. 332.
Belfiore et al., "Removal of Uranium and Thorium from Artificially and Routinely Contaminated Surfaces Using Attapulgus Clay Suspensions With and Without Mineral Acids," Journal of the Less-Common Metals, 122 (1986) pp. 515-518.
"Innovations, Mighty Mica, Synthetic Clay Remediates Radium," Environmental Health Perspectives, vol. 110, No. 9, Sep. 2002.
U.S. Patent Application Serial No. entitled "Long Lasting Decontamination Foam," filed concurrently herewith, Feb. 7, 2006.

* cited by examiner

SURFACE DECONTAMINATION COMPOSITIONS AND METHODS

GOVERNMENT RIGHTS

This invention was made with government support under Contract No. DE-AC07-05ID14517 awarded by the United States Department of Energy. The government has certain rights in the invention.

BACKGROUND OF THE INVENTION

1. Field of the Invention

The present invention relates generally to compositions for decontaminating surfaces and methods of using such compositions to decontaminate surfaces. More particularly, the present invention relates to clay-based compositions and methods of using such clay-based compositions to decontaminate a surface and/or a material having a surface.

2. State of the Art

Radioactive, biological, and other unwanted contaminants may adhere to surfaces or penetrate into porous materials upon exposure of the material to such contaminants. Often times, contamination resulting from such exposure is hazardous and must be removed in order to make the material safe for its intended use.

For example, materials and surfaces coming in contact with radioactive materials for the production of energy, production and use of radioactive medical devices, and the disposal of radioactive waste often become contaminated with radioactive materials that contact such surfaces. Human exposure to the resulting radioactive contamination on the surface of such materials is undesirable; therefore, contaminated surfaces and materials must be decontaminated before further use or they must be disposed of.

In addition, the increased availability of radioactive and bioactive materials has increased the probability that a "dirty-bomb" utilizing such materials may be used as a weapon for terrorist acts or in low-conflict warfare. If employed, weapons utilizing radioactive materials or bioactive materials would cause the spread of radioactive or bioactive contamination within a zone of activation. Materials, such as building materials, exposed to the radioactive or bioactive contamination would become contaminated. In order to safely decontaminate the exposed materials and surfaces, suitable and effective decontamination methods and compositions would need to be employed.

Although numerous methods and compositions may exist for removing radioactive contamination or bioactive contamination, many of the decontamination methods are costly or are destructive of the materials being decontaminated. For instance, concrete exposed to radioactive contamination may be decontaminated using active chemical agents and physical scrubbing techniques. Typically, concrete or other porous surfaces contaminated by radioactive materials are decontaminated by physical grit blasting of the surface of the contaminated material and chemical treatment of the surface. Costs associated with such decontamination methods are high, the amount of waste generated by such methods is large, and the waste must be specially disposed of due to the radioactive and hazardous nature of the waste. In addition, such decontamination processes are labor intensive. Further, grit blasting and chemical treatments usually only decontaminate the surface of a material and are rarely capable of treating the bulk of a material or a significant distance beyond surface contamination, if deeper contamination exists.

Therefore, it is desirable to develop methods for decontaminating surfaces exposed to radioactive contamination, bioactive contamination, or other forms of contamination. It is also desirable to provide decontamination compositions that may be used to decontaminate surfaces and sub-surfaces of materials that have been exposed to radioactive, bioactive, or other contaminants.

SUMMARY OF THE INVENTION

Embodiments of the invention include decontamination compositions and methods for decontaminating surfaces and sub-surfaces of contaminated materials.

According to some embodiments of the invention, a clay-based decontamination composition may be wetted or swelled with a solution that aids in decontamination of a surface. When applied to the clay-based composition, the solution provides ions to the decontamination composition, which ions may promote ion exchange between a contaminated material and the decontamination composition, allowing the decontamination composition to adsorb contaminants from a material surface to which it is applied.

According to other embodiments of the invention, decontamination compositions include clay-based montmorillonite compositions wetted or swelled with a potassium chloride solution. In some embodiments, the montmorillonite composition may include a sodium-montmorillonite or a calcium-montmorillonite composition.

Methods for decontaminating surfaces and materials are provided in other embodiments of the invention. In some embodiments, a decontamination composition according to embodiments of the invention is applied to a contaminated surface and allowed to remain on the surface for a period of time before being removed. In other embodiments, a contaminated surface is treated with a solution, such as the solution used to form the decontamination composition, by spraying, wiping, or otherwise applying the solution to the contaminated surface. A decontamination composition according to embodiments of the invention is then applied to the solution treated contaminated surface and allowed to remain there to promote decontamination before being removed. In still other embodiments, a contaminated surface may be treated with a decontamination solution or foam prior to the application of a decontamination composition of embodiments of the invention to the contaminated surface.

BRIEF DESCRIPTION OF THE DRAWINGS

While the specification concludes with claims particularly pointing out and distinctly claiming that which is regarded as the present invention, this invention can be more readily understood and appreciated by one of ordinary skill in the art from the following description of the invention when read in conjunction with the accompanying drawings in which:

DETAILED DESCRIPTION OF THE ILLUSTRATED EMBODIMENTS

According to embodiments of the present invention, a contaminated material may be partially or completely decontaminated by the application of a decontamination composition to the material and removal of the decontamination composition from the material. Decontamination compositions according to embodiments of the invention include clay or clay-like compositions wetted with one or more solutions, which compositions are capable of decontaminating a material or surface to which they are applied.

According to some embodiments of the invention, a decontamination composition may include a clay-based composition of montmorillonite. In other embodiments, the decontamination composition may also include other materials, components, or compositions, as desired. For example, decontamination compositions may include naturally occurring beidellite minerals, nontronite minerals, sponite minerals, hectorite minerals, sauconite minerals, and other smectite group minerals. Decontamination compositions may also include synthetic materials, such as synthesized smectite clays. Additional materials, solutions, and compositions added to the decontamination composition of embodiments of the present invention may alter the properties of the decontamination composition and in some instances improve the characteristics of the decontamination composition for certain uses.

Figure 1:
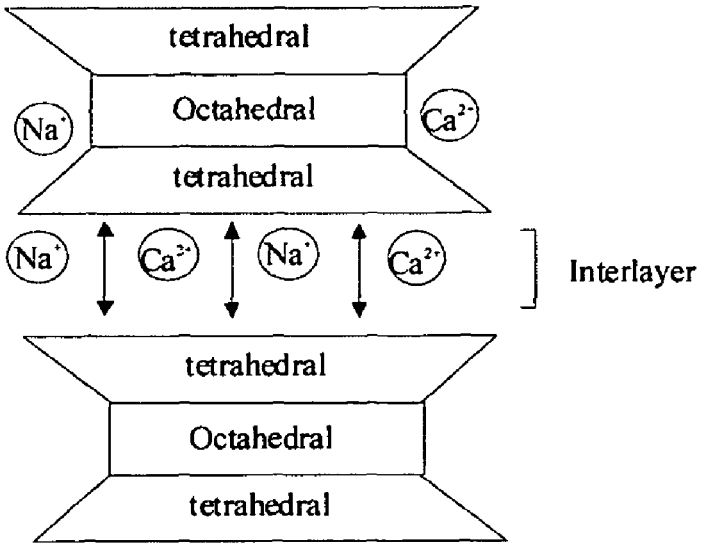
FIG. 1 illustrates a layered structure of a montmorillonite clay composition used with decontamination compositions according to embodiments of the invention.

Montmorillonite clay minerals are di-octrahedral layered silicates having an octahedral layer sandwiched between two tetrahedral layers as illustrated in FIG. 1. Montmorillonite may generally be represented by the following formula:

$$(\tfrac{1}{2}Ca,Na)_{0.7}(Al,Mg,Fe)_4[(Si,Al)_8O_{20}](OH)_4.$$

Montmorillonite clays have the capacity to expand or swell up to about 18 times their original size when exposed to water or a hydrating solution.

Montmorillonite clays exhibit excess negative charges that are generally balanced by adsorbed cations. Typically, montmorillonite clays have a cation exchange capacity of about 0.8 milliequivalents per gram and more than 90 percent of the exchange sites are located within the interlayer, as illustrated in FIG. 1. Additional exchange sites include edge or planar sites, which account for approximately 4 percent of the surface area of the montmorillonite clay composition. The exchange of ions in the montmorillonite clays is based upon the ion size and charge. For monovalent cations in Group 1A of the periodic table, the replacement power increases as follows: Li<Na<K<Rb<Cs. Thus, absorbed sodium (Na) ions in a montmorillonite clay formation could be readily replaced by potassium (K) ions. Similarly, for the divalent cations in Group 2A of the periodic table, the replacement power increases as follows: Mg<Ca<Sr<Ba, resulting in strontium (Sr) ions readily replacing adsorbed calcium (Ca) ions in a montmorillonite clay formation.

Naturally occurring montmorillonite clay formations are found in various locations around the world, including France, Italy, and the United States. In some embodiments of the invention, sodium-montmorillonite clays found in the Newcastle formation in the state of Wyoming, United States of America, can be used to form decontamination compositions. Sodium-bentonite clays found in the state of Texas, United States of America, can also be used to form decontamination compositions according to embodiments of the invention. In still other embodiments, clay produced and sold under the name VOLCLAY® SPV 200 by Rennecker Limited of Cleveland, Ohio, may be used to form decontamination compositions of the invention. Results of a chemical analysis of these three clays are shown in Table I.

TABLE I

| Analysis (wt. %) | SWY-2 | Texas Na-bentonite | VOLCLAY ® SPV 200 |
|---|---|---|---|
| $SiO_2$ | 62.9 | 63.5 | 63.02 |
| $Al_2O_3$ | 19.6 | 9.32 | 21.08 |
| $Fe_2O_3$ | 3.35 | 2.57 | 3.25 |
| FeO | 0.32 | | |
| MgO | 3.05 | 1.79 | 2.67 |
| CaO | 1.68 | 0.88 | 0.65 |
| $Na_2O$ | 1.53 | 4.06 | 2.57 |
| $K_2O$ | 0.53 | 1.28 | |
| F | 0.111 | | |
| $P_2O_5$ | 0.049 | | |
| S | 0.05 | | |
| LiO | 7.39 | 11.6 | 5.64 |
| size | | Min 65% <74 uM | Min 98% <74 uM |

Further analysis of the SWY-2 clay (sodium-montmorillonite clay from Wyoming) indicates that the cation exchange capacity of that clay is on the order of 76.4 milliequivalents per one-hundred grams of material. The principle exchange cations of the clay are sodium and calcium. In addition, the $N_2$ surface area of the clay composition is about 31.82+/−0.22 $m^2/g$. The octahedral charge is about −0.53, the tetrahedral charge about −0.02, the interlayer charge about −0.55, and the unbalanced charge about 0.05. The determined structure of the SWY-2 clay found in Wyoming is as follows:

$$(Ca_{0.12}Na_{0.32}K_{0.05})[Al_{3.01}Fe(III)_{0.41}Mn_{0.01}Mg_{0.54}Ti_{0.02}][Si_{7.98}Al_{0.02}]O_{20}(OH)_4$$

In some embodiments of the invention, sodium-montmorillonite clays, such as the SWY-2 clays, are used to form decontamination compositions of the invention. In other embodiments, however, calcium-montmorillonite clays or other montmorillonite clays may be used alone or mixed with sodium-montmorillonite clays to form decontamination compositions. In still other embodiments, the decontamination compositions may include bentonite, illite, smectite clays, or synthesized smectite clays, such as those used with wastewater treatment. The use of synthesized clays to form decontamination compositions of the invention provides for the customization of the clays, such that a particular clay may be formed to adsorb specific ions.

According to embodiments of the invention, a decontamination composition is formed by wetting a montmorillonite clay with a solution capable of inducing ion exchange of a contaminant from a surface or sub-surface of a material when the decontamination composition is applied to the material surface. The addition of the solution to the montmorillonite clay forces the montmorillonite clay to expand, resulting in the displacement of cations from the montmorillonite clay and replacement with cations from the solution. The expanded montmorillonite clay may then be applied to a contaminated surface, wherein cation exchange of the contaminants from the contaminated surface into the decontamination composition is induced.

For example, a decontamination composition according to embodiments of the invention may be formed by wetting a sodium-montmorillonite clay with a potassium chloride (KCl) solution. The addition of the potassium chloride solution to the sodium-montmorillonite clay causes expansion of the clay and an ion exchange of potassium ions for the sodium ions in the clay. The resulting expanded clay may be used as a decontamination composition according to embodiments of the invention.

Figure 2:
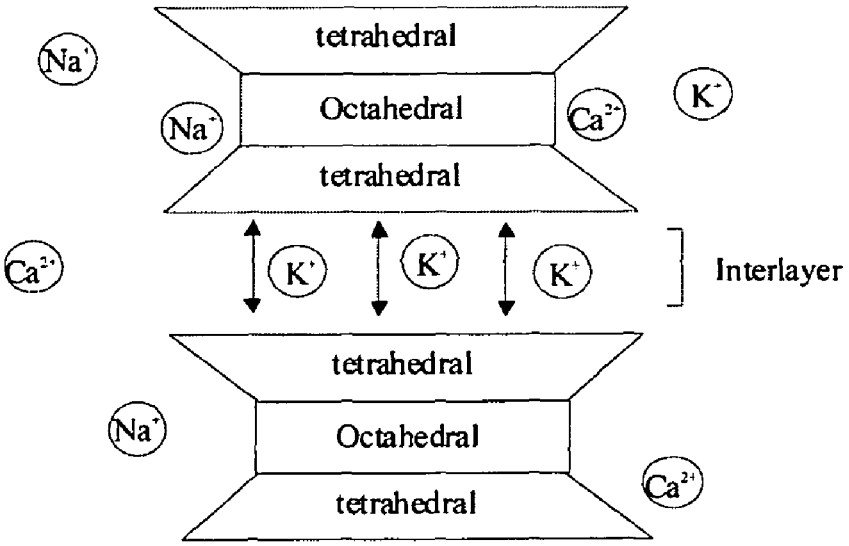
FIG. 2 illustrates a layered structure of a decontamination composition of the invention formed by an addition of a potassium chloride solution to a sodium-montmorillonite clay.

A simple illustration of a structure of a decontamination composition formed by the addition of a potassium chloride solution to sodium-montmorillonite clay is illustrated in FIG. 2. As illustrated, the potassium ions ($K^+$) replace the sodium ions ($Na^+$) in the interlayer of the montmorillonite clay and at some planar locations. In some instances, some sodium ions and other ions, such as calcium ions ($Ca^+$), will also remain within the montmorillonite clay.

In some embodiments of the invention, the solutions used to wet the decontamination compositions include potassium chloride solutions; however, various other salt solutions may also be used with embodiments of the present invention. For example, other solutions may include zinc (Zn) containing solutions, rubidium (Rb) containing solutions, and lithium (Li) containing solutions. Preferably, a solution selected for use with embodiments of the invention includes an ionic charge concentration of about 35 milliequivalents or less. In some embodiments, the solution is added to a clay composition in a four to one (4:1) ratio. In other embodiments, the solution is added to a clay composition in a ratio sufficient to expand the clay composition such that ion exchange and contamination capture may be achieved by the decontamination composition.

Solutions used with embodiments of the invention may also include an acid or a base. Inclusion of an acid or base in a solution may optimize the decontamination process by providing improved decontamination effects against certain contaminants. For example, hydrochloric acid may be added to the solution to aid in the removal of contaminants from a material being decontaminated. The addition of an acid or a base may help to adapt the solution for the removal, or more effective removal, of a particular contaminant. Therefore, decontamination compositions according to embodiments of the invention may be customized to remove a selected contaminant based in part upon the composition of the solution used to form the decontamination composition.

Furthermore, the addition of an acid or base to the solution may help to maintain the pH of the solutions used with embodiments of the invention. In some embodiments of the invention, it is preferred to maintain a pH of the solution between about 4 and about 7. In other embodiments, a pH of the solution is preferably between about 3 and about 9.

As previously discussed, potassium chloride solutions may be used with embodiments of the present invention. For example, potassium chloride solutions added in a four to one (4:1) ratio to sodium-montmorillonite clays may be used with embodiments of the invention. Other ratios of solution to clay may also be used. The concentration of the potassium chloride solutions is preferably between about 15 mMol KCl and about 200 mMol KCl, although other concentrations may also be used with embodiments of the invention. For example, the concentration of potassium chloride solutions may be between about 15 mMol KC1 and 35 mMol KCl or between about 5 mMol KCl and about 50 mMol KCl.

According to embodiments of the invention, a method for decontaminating a surface includes the application of a decontamination composition to the surface followed by removal of the decontamination composition a period of time later. Decontamination compositions according to embodiments of the invention may be applied in any manner, including, but not limited to, spraying, smearing, wiping, or otherwise applying the decontamination compositions to a surface or material. In other embodiments, the surface may be pretreated with a solution prior to the application of the decontamination composition to the surface. The solution used for pretreatment may include a solution used to wet the decontamination composition prior to application of the decontamination composition to the surface. According to still other embodiments, the surface may be treated with a decontamination treatment, such as a decontamination foam, which is removed prior to pre-pretreatment of the surface with a solution and the application of the decontamination composition.

For instance, a decontamination composition formed from sodium-montmorillonite clay wetted by a potassium chloride solution may be applied to a contaminated surface to remove at least a portion of the contamination from the surface and sub-surface of the material. The application of a decontamination composition to a contaminated surface treats or decontaminates both the surface and the sub-surface of the material. Decontamination compositions according to embodiments of the invention are capable of removing contamination from a sub-surface and pores of a material or surface.

When applied to a contaminated surface or material, decontamination compositions according to embodiments of the invention act in a similar manner to a poultice treatment, pulling contaminates off of the surface and out of the pores of the material. Application of the decontamination compositions to a surface also facilitates the diffusion of contaminants from a substrate or material to the surface of the material where the contaminants are sequestered by the decontamination composition.

Figure 3:
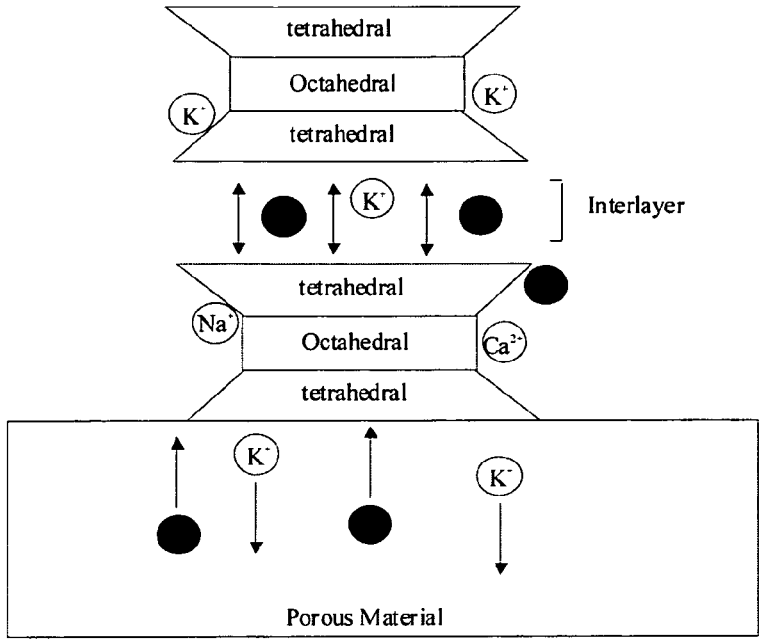
FIG. 3 illustrates a decontamination composition of embodiments of the invention applied to a contaminated surface.

FIG. 3 provides a simple illustration of a montmorillonite decontamination composition wetted with a potassium chloride solution according to embodiments of the invention, which has been applied to a surface of a porous material. As illustrated, the potassium ions in the decontamination composition provide for an ion exchange with the porous material. The contaminate ions, represented by solid black circles, diffuse to the surface of the porous material where the decontamination composition acts as a zero-concentration boundary. The contaminate ions diffuse through the porous surface to the zero-concentration boundary where they are adsorbed or sequestered by the decontamination composition. The contaminant ions may be sequestered in the interlayer or at surface sites of the decontamination composition.

The decontamination compositions according to embodiments of the invention may be applied to a surface in any thickness and in any manner. However, in some embodiments it is preferred to apply the decontamination compositions in a thickness of between about 0.5 centimeter to about 1 centimeter.

In some embodiments of the invention, a contaminated surface is wetted with a solution, such as that used to form the decontamination compositions, prior to the application of the decontamination composition to the surface. Application of a solution to the surface prior to application of a decontamination composition of the present invention helps to promote ion exchange between the decontamination composition and the contaminated surface. In addition, the wetting of the contaminated surface with the solution prior to application of the decontamination composition may facilitate application of the decontamination composition to the surface. For example, in some instances a decontamination composition may adhere to a wetted surface better than to a non-wetted surface. Furthermore, application of a solution to a surface prior to application of a decontamination composition initiates a wetting of the surface and sub-surface of the contaminated surface. The wetting of the surface promotes the penetration of the solution into the pores of the surface and initiates ion exchange of contaminant ions from the sub-surface into a decontamination composition applied to the surface.

According to other embodiments of the invention, a decontamination composition may be applied to a contaminated surface that has been previously treated to reduce the contamination on the surface or within the structure of the contaminated surface. For example, a decontamination foam as described in corresponding U.S. patent application Ser. No. 11/349,815 titled "LONG LASTING DECONTAMINATION FOAM," filed on Feb. 7, 2006, now U.S. Pat. No. 7,846,888, issued Dec. 7, 2010, and incorporated herein by reference in its entirety, may be applied to a contaminated surface to remove an initial amount of contamination from the surface. Following removal of one or more applications of the decontamination foam, a decontamination composition of the present invention may be applied to the surface to further promote decontamination of the surface. As with other embodiments, the surface may be treated with a solution prior to application of the decontamination composition. The combined use of a decontamination foam for initial decontamination of the surface, followed by decontamination of the surface and sub-surface using a decontamination composition according to embodiments of the invention may provide improved decontamination of the contaminated surface or material.

Once applied to a surface, decontamination compositions may also thereafter be treated or wetted with a solution. For example, a decontamination composition applied to a surface may begin to dry out due to evaporative losses. A solution, such as a salt solution, electrolyte solution, or a solution used to form the decontamination composition, may be applied to a decontamination composition that has been applied to a surface to help maintain the moisture content of the applied decontamination composition. Application of a solution to an applied decontamination composition may be by any of numerous methods, including, but not limited to, by spraying the solution on the composition, running a solution over the composition, attaching a sponge or other material, such as a wettable fabric or webbing, to the composition, coating the decontamination composition with a wax or other material to retain moisture in the composition, or by other known methods for wetting a surface.

Once applied, a decontamination composition may be removed from a surface by any known methods. In some embodiments, the decontamination composition applied to a surface may be allowed to dry such that the decontamination composition readily falls away from a surface, may be easily chipped away, or otherwise mechanically removed. In other embodiments, the wetted decontamination composition may be removed and collected before drying.

After removal, the decontamination compositions will exhibit levels of contamination based upon the amount of contamination removed from the contaminated surface. In order to contain the removed contamination, the decontamination compositions may be dried to reduce the size or volume of the now-contaminated decontamination composition and stored. In other embodiments, the contaminants removed from the surface by the decontamination composition may be recovered from the decontamination composition.

The decontamination compositions according to embodiments of the present invention may be used to remove radioactive, bioactive, or chemical contaminants. For example, radioactive contaminants such as cobalt and cesium may be removed from a surface, material, or substrate using decontamination compositions according to embodiments of the invention. Other radioactive, bioactive, and chemical contaminants may also be removed.

In general, decontamination compositions according to embodiments of the present invention may be applied to any surface or material to remove contamination. In many embodiments, the decontamination compositions may be applied to structural or building materials such as concrete, wood, marble, granite, glass and other materials. For example, structural materials exposed to radiation from a radiation leak or dirty bomb may be treated with decontamination compositions of the invention to remediate the contamination. Likewise, structural materials exposed to bioactive contaminants may also be treated according to embodiments of the invention.

EXAMPLES

Various samples of decontamination compositions according to embodiments of the present invention were applied to contaminated surfaces that had been pretreated with decontamination foams such as those described in the aforementioned U.S. patent application titled "LONG LASTING DECONTAMINATION FOAM," now U.S. Pat. No. 7,846,888, issued Dec. 7, 2010. The average decontamination achieved by the decontamination compositions on three particular surfaces—marble, granite, and concrete—is summarized in Examples 1 through 3. For each of Examples 1 through 3, the decontamination composition included SWY-2 sodium-montmorillonite clay from Wyoming, hydrated with a solution of 15 mMol potassium chloride (KCl) in deionized water. The ratio of solution to clay was four parts solution to one part clay (4:1) and the pH of the decontamination compositions was about 8. Once prepared and applied, each of the samples was placed into a plastic container with a tight sealing lid, along with some wet sponges.

Example 1

Radioactive Contaminant on Marble

A marble surface contaminated with radioactive material was treated with two applications of a foam decontamination composition. The foam decontamination composition removed 72 percent of the contamination from the marble. A decontamination composition formed from sodium-montmorillonite according to embodiments of the present invention was then applied to the marble surface and was left on the surface for about a thirty-day period. Prior to application of the decontamination composition, a solution of 20 mMol potassium chloride (KCl) in deionized water was applied to the marble surface using a spray bottle. The treated surface was stored in a sealed container with some wet sponges during the thirty-day period. Following the thirty-day period, the decontamination composition was removed from the marble surface. Testing of the marble surface revealed that the decontamination composition further reduced the amount of contamination on the marble, from a total of 72 percent removal by the foam alone to 95 percent removal using the combination of the foam followed by the decontamination composition.

Figure 4:
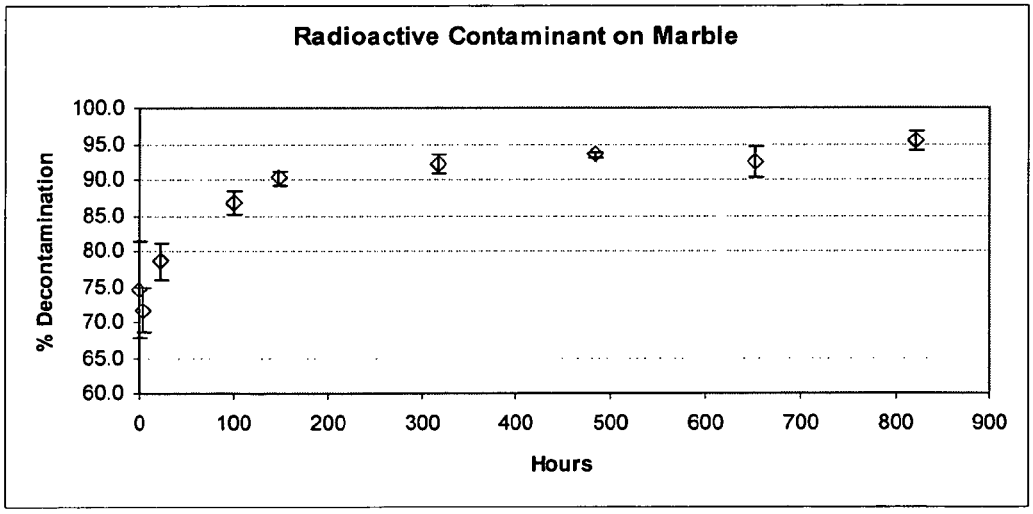
FIG. 4 is a graph illustrating results of contamination testing of a marble surface over time which reflect decontamination due to decontamination compositions of embodiments of the invention.

Sampling of the contamination on the marble during testing was performed. Results illustrating removal of the radioactive contamination by the decontamination composition over time are illustrated in FIG. 4.

Example 2

Radioactive Contaminant on Concrete

A concrete surface contaminated with radioactive material was treated with two applications of a foam decontamination composition. The foam decontamination composition removed 29 percent of the contamination from the concrete. A decontamination composition formed from sodium-montmorillonite according to embodiments of the present invention was then applied to the concrete surface and was left on the surface for about a thirty-day period. Prior to application of the decontamination composition, a solution of 20 mMol potassium chloride (KCl) in deionized water was applied to the concrete surface using a spray bottle. The treated surface was stored in a sealed container with some wet sponges during the thirty-day period. Following the thirty-day period, the decontamination composition was removed from the concrete surface. Testing of the concrete surface revealed that the decontamination composition further reduced the amount of contamination on the concrete, from a total of 29 percent removal by the foam alone to 87 percent removal using the combination of the foam followed by the decontamination composition.

Figure 5:
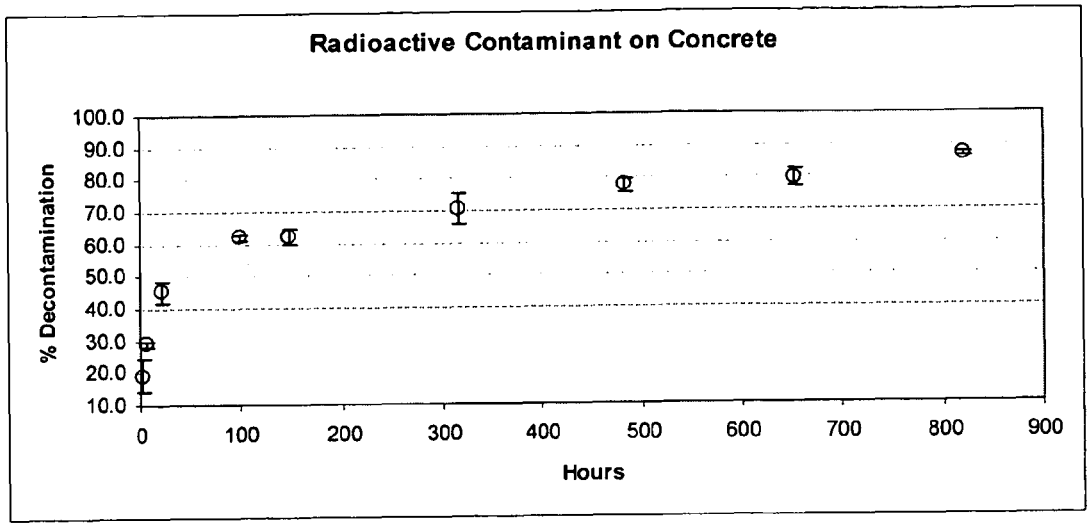
FIG. 5 is a graph illustrating results of contamination testing of a concrete surface over time which reflect decontamination due to decontamination compositions of embodiments of the invention.

Sampling of the contamination on the concrete during testing was performed. Results illustrating removal of the radioactive contamination by the decontamination composition over time are illustrated in FIG. 5.

Example 3

Radioactive Contaminant on Granite

A radioactively contaminated granite surface was treated with two applications of a foam decontamination composition. A decontamination composition formed from sodium-montmorillonite according to embodiments of the present invention was then applied to the granite surface and was left on the surface for about a thirty-day period. Prior to application of the decontamination composition, a solution of 20 mMol potassium chloride (KCl) in deionized water was applied to the granite surface using a spray bottle. The treated surface was stored in a sealed container with some wet sponges during the thirty-day period. Following the thirty-day period, the decontamination composition was removed from the granite surface. Testing of the granite surface revealed that the decontamination composition further reduced the amount of contamination on the granite, from a total of 52 percent removal by the foam alone to 75 percent removal using the combination of the foam followed by the decontamination composition.

Figure 6:
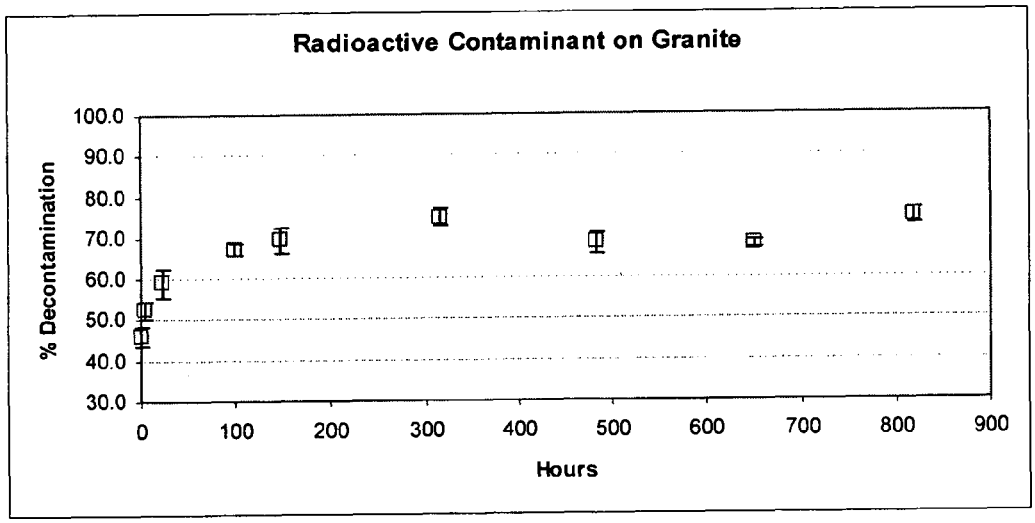
FIG. 6 is a graph illustrating results of contamination testing of a granite surface over time which reflect decontamination due to decontamination compositions of embodiments of the invention.

Sampling of the contamination of the granite during testing was performed. Results illustrating removal of the radioactive contamination by the decontamination composition over time are illustrated in FIG. 6.

Various fluids were also tested as hydrating solutions for the decontamination compositions according to embodiments of the present invention. The results achieved employing the various hydrating solutions with embodiments of the present invention are discussed below. The increases in contamination removal reflect increases over contamination removal using decontamination foams such as those described in the aforementioned U.S. patent application titled "LONG LASTING DECONTAMINATION FOAM," now U.S. Pat. No. 7,846,888, issued Dec. 7, 2010.

Example 4

15 mMol Potassium Chloride Hydrating Solution

A decontamination composition according to embodiments of the invention was formed using a hydrating solution of 15 mMol potassium chloride (KCl). The ratio of hydrating solution to sodium-montmorillonite was four to one (4:1) and the pH of the decontamination composition was 7.9. Application of the decontamination composition to a contaminated surface resulted in an increase in decontamination of the surface by 17 percent over a one-day period.

Example 5

35 mMol Potassium Chloride Hydrating Solution

A decontamination composition according to embodiments of the invention was formed using a hydrating solution of 35 mMol potassium chloride (KCl). The ratio of hydrating solution to sodium-montmorillonite was four to one (4:1) and the pH of the decontamination composition was 7.9. Application of the decontamination composition to a contaminated surface resulted in an increase in decontamination of the surface by 40 percent over a four-day period.

Example 6

40 mMol Potassium Chloride Hydrating Solution

A decontamination composition according to embodiments of the invention was foil ied using a hydrating solution of 40 mMol potassium chloride (KCl). The ratio of hydrating solution to sodium-montmorillonite was four to one (4:1) and the pH of the decontamination composition was 7.9. Application of the decontamination composition to a contaminated surface resulted in an increase in decontamination of the surface by 15 percent over a four-day period. The decontamination composition formed according to this embodiment, however, lacked sufficient viscosity to remain intact and in position on a vertical surface.

Example 7

200 mMol Potassium Chloride Hydrating Solution

A decontamination composition according to embodiments of the invention was formed using a hydrating solution of 200 mMol potassium chloride (KCl). The ratio of hydrating solution to sodium-montmorillonite was three to two (3:2). Application of the decontamination composition to a contaminated surface resulted in an increase in decontamination of the surface by 35 percent over a four-day period.

Example 8

15 mMol Zinc Chloride Hydrating Solution

A decontamination composition according to embodiments of the invention was formed using a hydrating solution of 15 mMol zinc chloride ($ZnCl_2$). The ratio of hydrating solution to sodium-montmorillonite was four to one (4:1) and the pH of the decontamination composition was 7.9. Application of the decontamination composition to contaminated concrete surfaces did not result in an increase in decontamination of the surfaces.

Example 9

20 mMol Zinc Chloride Hydrating Solution

An attempt to form a decontamination composition according to embodiments of the invention was made using a hydrating solution of 20 mMol zinc chloride ($ZnCl_2$). The ratio of hydrating solution mixed with sodium-montmorillonite was four to one (4:1) and the pH of the decontamination composition was 7.9. Mixing of the hydrating solution and the sodium-montmorillonite failed to completely hydrate the sodium-montmorillonite clay. The resulting composition was a hydrating solution with sodium-montmorillonite clay flocculated out of the hydrating solution.

Example 10

0.01 Mol Hydrochloric Acid Hydrating Solution

A decontamination composition according to embodiments of the invention was formed using a hydrating solution of 0.01 Mol hydrochloric acid (HCl). The ratio of hydrating solution to sodium-montmorillonite was four to one (4:1) and the pH of the decontamination composition was 7.2. Application of the decontamination composition to contaminated concrete surfaces resulted in an increase in decontamination of the surfaces by 36 percent over a four-day period.

A summary of the results obtained using these various hydrating solutions with embodiments of the invention are illustrated in Table II.

TABLE II

| Hydrating Fluid | Ratio of hydrating fluid to clay (w/w) | pH | Result |
|---|---|---|---|
| 15 mMol KCl | 4:1 | 7.9 | After 1 day of treatment, decontamination increased 17 percent over base treatment |
| 35 mMol KCl | 4:1 | 7.9 | After 4 days of treatment, decontamination increased 40 percent over base treatment |
| 40 mMol KCl | 4:1 | 7.9 | After 4 days of treatment, decontamination increased 15 percent over base treatment. However, the suspension lacked viscosity and would not remain intact on a vertical surface |
| 200 mMol KCl | 3:2 | | After 4 days of treatment, decontamination increased 35 percent over base treatment. |
| 15 mMol $ZnCl_2$ | 4:1 | 7.9 | No increase in decontamination over base treatment. |
| 20 mMol $ZnCl_2$ | 4:1 | 7.9 | The clay would not hydrate to form a paste. It flocculated out of the hydrating solution. |
| 0.01M HCl | 4:1 | 7.2 | After 4 days of treatment, decontamination increased 36 percent over base treatment. |

Having thus described certain currently preferred embodiments of the present invention, it is understood that the invention defined by the appended claims is not to be limited by particular details set forth in the above description, as many apparent variations thereof are contemplated without departing from the spirit or scope thereof as hereinafter claimed.

The invention claimed is:

1. A composition, comprising:

a clay composition comprising SWY-2 clay and having interlayer boundaries;

a solution comprising about 15 mMol to about 200 mMol potassium chloride mixed with the clay composition;

wherein the solution comprises an ionic charge concentration of about 35 milliequivalents or less;

wherein the solution provides ions in at least a portion of the interlayer boundaries of the clay composition; and wherein the solution is mixed with the clay composition in a ratio of four to one (4:1) to form the composition.

2. A method for treating a surface contaminated with radiation, comprising:

applying the composition of claim 1 to the surface contaminated with radiation in a thickness of between about 0.5 centimeters and about 1 centimeter;

allowing the composition of claim 1 to remain on the surface contaminated with radiation for at least 100 hours; and removing the composition.

3. The method of claim 2, further comprising treating the surface contaminated with radiation with a decontamination foam for a period of time and removing the decontamination foam prior to applying the composition of claim 1 to the surface contaminated with radiation.

4. The composition of claim 1, wherein the composition has a pH between about 4 and about 7.

5. The composition of claim 1, wherein the solution consists of potassium chloride and water.

6. A composition, consisting of:

SWY-2 clay;

a solution of about 15 mMol to about 200 mMol potassium chloride and water mixed with the clay composition;

wherein the solution has an ionic charge concentration of about 35 milliequivalents or less; and wherein the solution is mixed with the clay composition in a ratio of four to one (4:1) to form the composition.

* * * * *

UNITED STATES PATENT AND TRADEMARK OFFICE

CERTIFICATE OF CORRECTION

PATENT NO. : 7,915,472 B2
APPLICATION NO. : 11/350351
DATED : March 29, 2011
INVENTOR(S) : Karen E. Wright et al.

It is certified that error appears in the above-identified patent and that said Letters Patent is hereby corrected as shown below:

In the specification:

COLUMN 10, LINE 36, change "foil ied" to --formed--

Signed and Sealed this
Sixteenth Day of February, 2016

Michelle K. Lee

Michelle K. Lee
*Director of the United States Patent and Trademark Office*